US009951487B1

(12) United States Patent
Gonzalez De Cosio Leal

(10) Patent No.: US 9,951,487 B1
(45) Date of Patent: Apr. 24, 2018

(54) ELEVATION MECHANISM FOR AN ARTICULATED PLATFORM FOR STREETS

(71) Applicant: Luis Ricardo Gonzalez De Cosio Leal, Michoacan (MX)

(72) Inventor: Luis Ricardo Gonzalez De Cosio Leal, Michoacan (MX)

( * ) Notice: Subject to any disclaimer, the term of this patent is extended or adjusted under 35 U.S.C. 154(b) by 0 days.

(21) Appl. No.: 15/392,669

(22) Filed: Dec. 28, 2016

(51) Int. Cl.

| | |
|---|---|
| ***E01F 9/00*** | (2016.01) |
| ***E01F 9/529*** | (2016.01) |
| *E01F 9/608* | (2016.01) |
| *E01F 9/615* | (2016.01) |

(52) U.S. Cl.
CPC ..... *E01F 9/529* (2016.02); *E01F 9/608* (2016.02); *E01F 9/615* (2016.02)

(58) Field of Classification Search
CPC ..... E01F 9/529; E01F 9/608; E01F 9/615
USPC ..... 404/6, 15
See application file for complete search history.

(56) References Cited

U.S. PATENT DOCUMENTS

| | | | | |
|---|---|---|---|---|
| 5,267,808 | A | 12/1993 | Welford | |
| 5,509,753 | A | 4/1996 | Thompson | |
| 6,457,900 | B2 | 10/2002 | Bond | |
| 7,645,090 | B2 | 1/2010 | Rastegar et al. | |
| 9,677,232 | B2 * | 6/2017 | Zwerneman | E01F 9/529 |
| 2013/0209169 | A1 * | 8/2013 | Chew | E01F 13/048 404/15 |
| 2014/0227031 | A1 * | 8/2014 | Fifi | E01F 9/529 404/15 |

* cited by examiner

*Primary Examiner* — Raymond W Addie
(74) *Attorney, Agent, or Firm* — Andrew W. Chu; Craft Chu PLLC

(57) ABSTRACT

A selectively activated speed bump is placed on streets to slow down vehicles. The cover has a central part and lateral parts on both sides of the central part. An elevation movement mechanism for the cover is installed in a rectangular pit formed by a box. A shaft has a terminal end joined to pillow blocks inside the box and a plurality of cams, being flexible offset discs, along a length of the shaft. The cams turn to raise the cover to a higher level than the ground and continue to turn in order to return the cover to the same height of the ground. The speed bump slows vehicles on streets and on avenues.

4 Claims, 6 Drawing Sheets

ELEVATION MECHANISM FOR AN ARTICULATED PLATFORM FOR STREETS

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention refers to a speed bump with selective actuation. The speed bump relates to a method to control speed. The speed bump can be installed in those streets where there is a large amount of traffic and where it is necessary to reduce the speed of vehicles.

2. Description of Related Art Including Information Disclosed Under 37 CFR 1.97 and 37 CFR 1.98

At present, the number of vehicles has increased and, as a consequence, traffic problems have multiplied. Restrictions have been imposed, including fixed signals, bumpers on the ground, and lighted signals, such as traffic lights and many others.

Yet, now a more efficient mechanism to control speed is required, mainly when road safety education is lacking, and many do not respect the allowed speed limits.

To date, automatic and dynamic systems to stop the speed of a vehicle and to force drivers to respect the speed limit are not known.

The prior art systems available now to stop vehicles include an external pole placed on the streets with an operation button, which, when pushed, activates the traffic light to red for a certain time so that pedestrians can cross.

BRIEF SUMMARY OF THE INVENTION

The selectively activated speed bump is able to increase or to reduce its height, and thus, cause the limitation of speed. The invention can also incorporate an audio system with the mechanical system. This audio system is ideal to detect high frequency sounds, such as those that correspond to a siren or a bell. Thus, the speed bump is able to fully reduce its height in order to allow an ambulance, a fire truck or a police car to pass. At the same time, a control for pedestrians, who have to cross the street safely, has also been incorporated. This control keeps the speed bump elevated long enough for the pedestrians to cross, regardless of the vehicle flow. In addition, the speed bump incorporates an electronic card that includes a communication module to send information related to the vehicle flow, such as statistics on vehicle pollution and road safety behavior.

The speed bump has a mass sensor, a sound sensor or a radar signal, all in communication with a control box, and when control box receives these signals from the sensors, whether based on information detected manually, visually or audibly, are transmitted to the control box, having an electronic platform that can include an embedded software or firmware. The control box is a fundamental element to manage information by determining the switch between raised and lowered positions, according to transmitted signals. The control box can be connected to an electric motor. This electric motor moves some offset cams, which engage the cover. The cams move the cover between the raised position and the lowered position so as to limit speed of a vehicle on the street.

In one embodiment, there is an audio sound, such as an ambulance siren. The sound sensor detects the audio sound and transmits a signal to an electronic card of the control box, which gives the order to lower the cover until the vehicle passes. In another embodiment for pedestrian crossing, a button placed externally at a button station has been included. The button station transmits a signal corresponding to the button being pushed to the control box, which gives the order for the cover raise for a certain time, sufficient for the pedestrians to cross the street.

The electronic card can also have a module to send information to a web server to monitor vehicle flow, generate statistics and calculate pollution.

For all the above reasons, the scope of the invention is included among those system, which limit the speed of vehicles on streets and avenues, and more particularly a cover or platform that can be raised by means of a mechanism.

Objectives of the Invention

This invention refers to a selectively actuated speed bump being comprised of a cover with a raised position, and a lowered position. The speed bump is placed on streets to limit the speed of vehicles. Vehicles are forced to reduce their speed when they get close to the speed bump, when the cover is in the raised position.

A purpose of this invention is to make installation of the speed bump easy on any avenue or boulevard, particularly on those streets, where traffic is heavy.

Another objective of this invention is to place the speed bump on those streets where controlling speed is required, such as streets with hospitals, clinics or schools.

A unique characteristic of this invention is strength with which the speed bump can stand the pressure exerted by a vehicle on the plates of the cover, when a vehicle passes over the speed bump.

A purpose of this invention is to make the installation and the placement of the speed bump easy and fast.

Another characteristic of this invention is a mechanical component to raise the parts of the cover. Vehicles will have to reduce their speed and cross over the cover or platform at a lower speed to reduce any ill effects on the suspension and the tires, which makes a safe crossing for pedestrians more likely.

Another purpose of this invention is to force drivers to reduce their speed when they see the speed bump.

Likewise, a purpose of this invention is to have an audio sensor to selectively actuate the speed bump for allowing ambulances, fire trucks or police cars to pass, when the frequency of their sirens is detected.

At the same time, another purpose of this invention is to send information about the flow of vehicles via Internet or via a similar system to a server to be analyzed and corrected.

DETAILED DESCRIPTION OF THE INVENTION

About the above-mentioned figures, the speed bump comprises a metal rectangular box 10, on the top of which there is a cover having three parts, a central part 30 and two lateral parts 32. The cover in the raised position can form a bump that causes a vehicle to reduce its speed. If speed is not reduced, the lower parts of the vehicle are hit, and this blow can break or damage parts of the vehicle, such as the wheels.

Figure 1:
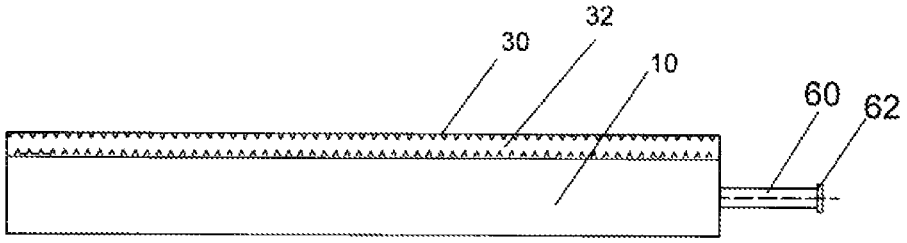
FIG. 1 is the front elevation schematic view of the elevation box of the speed bump facing the street.
Figure 2:
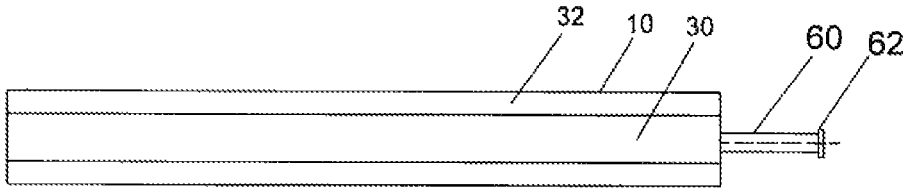
FIG. 2 is the top plan schematic view of the elevation box of the speed bump for streets
Figure 3:
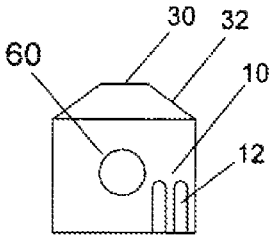
FIG. 3 is the side elevation schematic view of the elevation box of the speed bump for streets.
Figure 4:
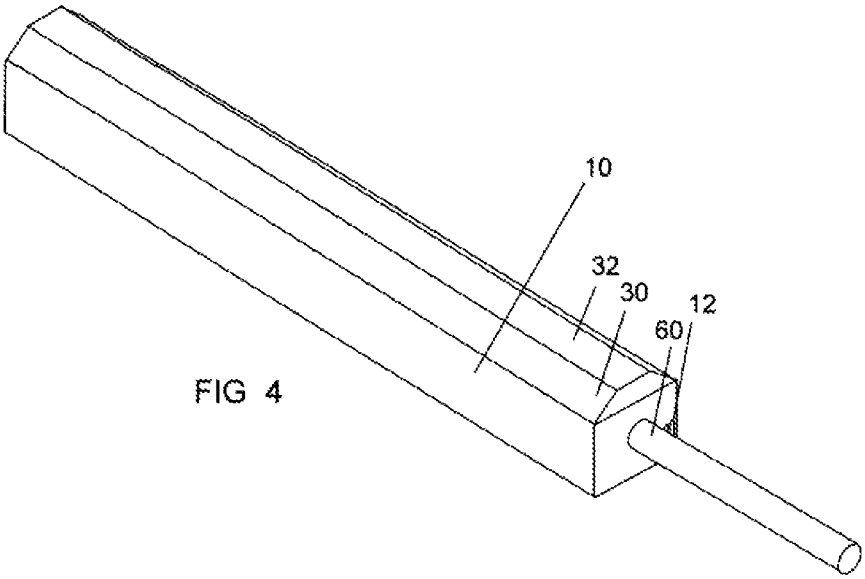
FIG. 4 is a perspective view of the elevation box of the speed bump for streets.
Figure 11:
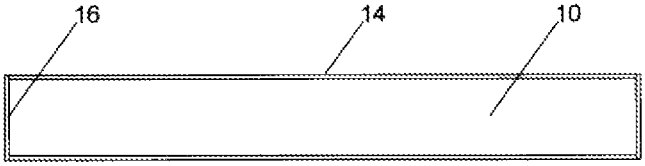
FIG. 11 is a top plan view of the box.
Figure 12:
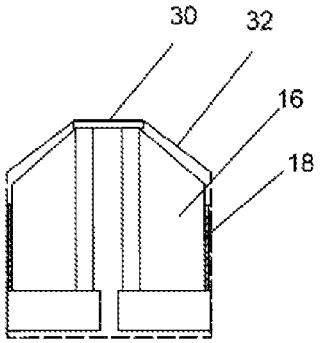
FIG. 12 is a side elevation view of the box combined with the support of the central part.

This box 10, from a top view of FIG. 11, shows a frame 14 within the box to reinforce box 10. The frame can support the lateral parts 32 and act as a rest for the lateral parts 32. The box has side walls 16' on longitudinal sides of the box and end walls 20' at opposite ends of the box. There are some grooves 12 in at least one end wall 20', according to FIG. 3, to drain the box in the event of flooding. The box can discharge any liquid through the grooves into a drain in the street. On the end walls 20', in FIGS. 11 and 12, there are some security plates 16. Each security plate 16 has a displaced position when the cover in is the raised position. The security plates 16 seal the box, not allowing foreign particles to enter the box 10 and acting as a security element to prevent a hand or a foot from entering the box 10. There are also safety plates 18 on respective side walls 16' of the box 10, as in FIG. 12. The safety plates 18 can be placed on fore-edges of the side walls 16' and can be comprised of plastic, such as nylon. The safety plates 18 act as guides and soften impacts on the box. The safety plates 18 reduce noise caused by vehicles or trucks driving the speed bump.

Figure 5:
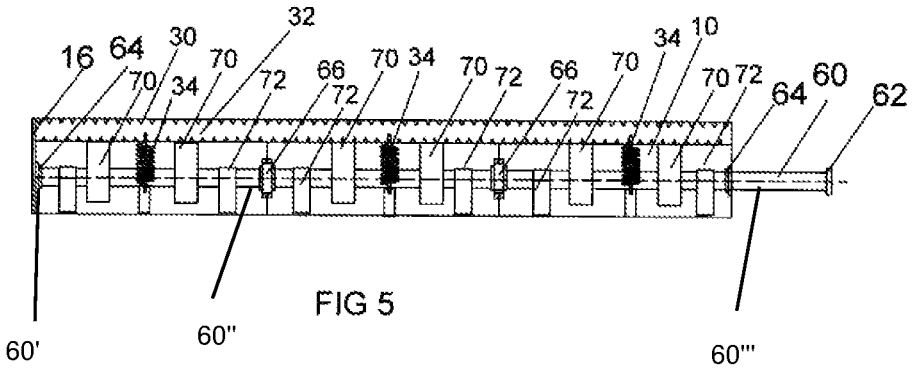
FIG. 5 is a sectional view of the elevation box of the speed bump for streets.

On one of the end walls 20' of the box 10, as seen in FIG. 5, there is a shaft 60 through the center of the box 10. The shaft 60 has an axle end 60''' connected to a flexible coupling 62. The flexible coupling 62 can join to a second shaft 120' as in FIG. 16. The second shaft 120' connects to a movement mechanism installed in the control box 120. The shaft 60 further includes a terminal end 60' supported on an end wall 20' of the box 10 by a pillow blocks 64 and a center portion 60" being reinforced with a plurality of bearing units 66 within the box, according to FIG. 5.

Figure 6:
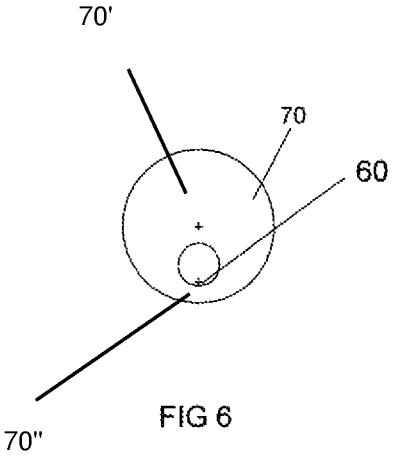
FIG. 6 is a front elevation view of the cam of the elevation mechanism of the speed bump.
Figure 7:
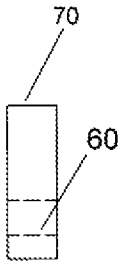
FIG. 7 is a side elevation view of the elevation mechanism of the speed bump.
Figure 8:
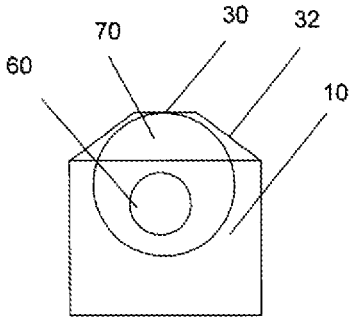
FIG. 8 is a side elevation view of the elevation box together with the cam that raises the cover.
Figure 9:
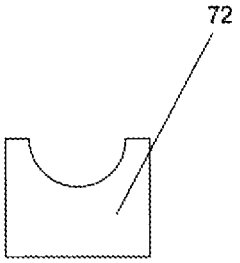
FIG. 9 is a front elevation view of the shaft support.
Figure 10:
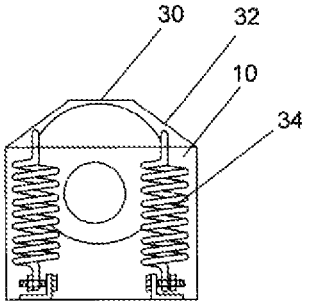
FIG. 10 is a side elevation view of the box combined with the springs of the lateral parts.

The central part 30 and two lateral parts of the cover move between the raised position and the lowered position by eccentric cams 70. Each cam 70 has a larger side 70' and a smaller side 70", as in FIG. 6. The cams 70 are mounted on the central portion 60" of the shaft 60, in FIG. 5. The cams 70 are aligned with the larger sides 70' engaged to the cover in the raised position. A sufficiently high protuberance is formed by the speed bump to stop the vehicles without damaging the vehicles.

Additionally, there are load supports 72 within the box to hold the shaft 60. Each load support 72 is between the shaft 60 and the bottom of the box, as in FIG. 5. Each load support 72 is spaced along the length of the shaft 60 and can be comprised of a block with a cross-cut. The cross-cut is shaped so that the shaft 60 sits slightly above the load support, without fully touching the load support. When a vehicle, truck or trailer does not reduce speed and goes over the cover in the raised position, the shaft 60 is fully pressed into each cross-cut of the load supports 72. Thus, the shaft 60 remains protected from possible harm caused by too much weight room a speeding vehicle.

An electric motor is connected to the flexible coupling 62 to the shaft 60, forming a rotating connection through the second shaft 120'. The electric motor can be the movement mechanism of the control box 120, as in FIG. 16. The electric motor is rotatable engaged to the shaft 60 to rotate the cams 70, engaging respective larger sides 70" to the cover in the raised position and releasing respective larger sides 70" from the cover in the lowered position.

A mass ultrasonic sensor can be in communication with the control box. The mass ultrasonic sensor can be comprised of a doppler oscillator, which transmits and receives microwaves having a distance range of two miles, such as 34.7 GHz frequency microwaves, to detect objects bigger than 10 cubic feet. The doppler oscillator can be powered or fed by 12 volts DC. Microwaves reflected from vehicles are detected by a receiver of the mass ultrasonic sensor, and the mass ultrasonic sensor sends signals to the control box, according to those microwaves reflected. Those signals switch the cover between the raised position and the lowered position. When the speed bump is installed on a street or avenue with a higher speed limit, the speed bump can include a radar 96, which operates in the same way as the mass ultrasonic sensor. That is, the radar is in communication with the control box. The signals sent by the radar are communicated to the control box to switch the cover between the raised position and the lowered position.

The present invention can also include a light dot matrix panel 92 in communication with the control box, wherein signals sent by the mass ultrasonic sensor, radar, or a sound sensor are communicated to the control box to generate a message corresponding to the signals displayed on the dot matrix panel. For example, the messages resulting from the signals from the radar 92 are displayed on a cluster of light-emitting diodes or groups of monochromatic amber light-emitting diodes with a visibility angle of 120 degrees and a vision distance of approximately 500 meters. In some embodiments, the display has the capacity of showing up to three lines of text.

In the embodiment with the mass ultrasonic sensor, microwaves can be transmitted constantly. If there is no object at the allowed distance of the microwaves, then the microwaves are not reflected to the receiver of the mass ultrasonic sensor. When a vehicle reflects the microwaves back to the receiver, the mass ultra-son sensor will send a signal to the control box to switch the cover to the lowered position so that the vehicle can pass.

Figure 13:
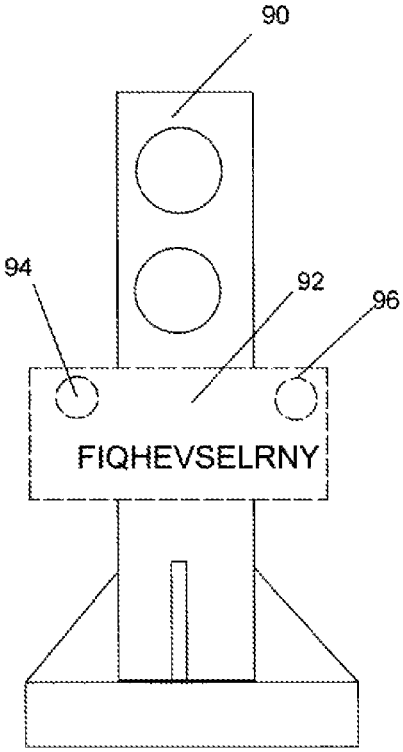
FIG. 13 is a schematic view of the indication light.

In another embodiment, there is a sound sensor 94, as in FIG. 13. The sound sensor is in communication with the control box. The signals sent by the sound sensor are communicated to the control box to switch the cover between the raised position and the lowered position. At a certain known distance and depending of the street conditions, the sound sensor 94 can also be placed near the location of a school, hospital or other location on the street. In still another embodiment, more than one sound sensor along the length of the street can work in the same way with different sounds being received to generate vehicle speed between sound sensor. The vehicle speed can determine the signals to the control box.

The present invention includes a programmable control card in communication with the control box. The signals sent by the programmable control card are communicated to the control box to switch the cover between the raised position and the lowered position. A signal corresponding to a vehicle above an allowed limit switches the cover to the raised position. Another signal corresponding to another vehicle lower or equal to the allowed limit switches the cover to the lowered position. For example, the programmable control card can receive data from two sound sensors for measuring the time that elapses between both sounds detected at the respective sound sensors. Knowing the time and the distance, speed can be calculated. The programmable control card as part of the control box sets the position of the cover.

Figure 16:
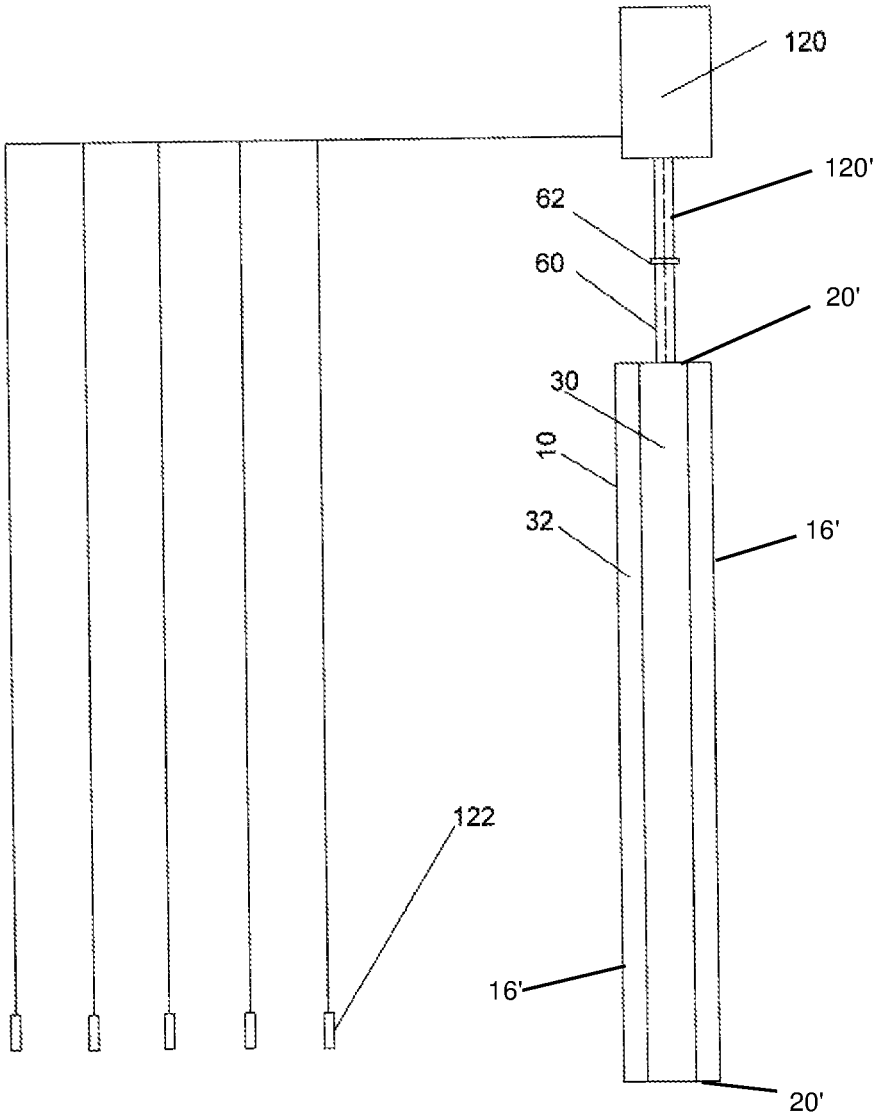
FIG. 16 is the top plan view of the elevation box combined with the displacement sensors.
Figure 17:
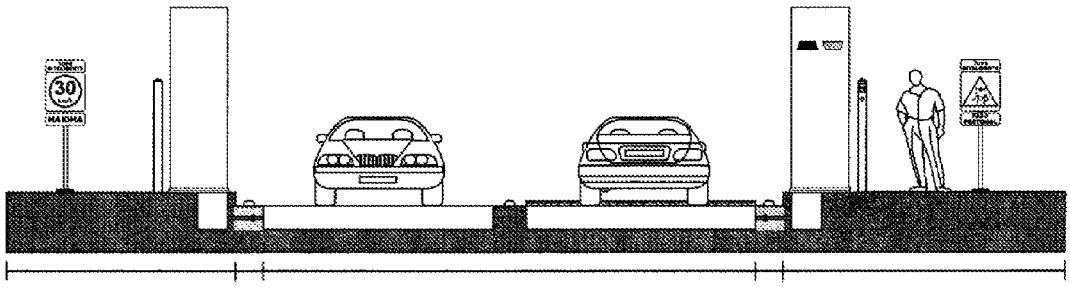
FIG. 17 is a schematic view of two boxes mounted underground for two vehicles and a schematic view of the control box where the electric motor, the gear box and the programmable control card are placed.

The same programmable control card can send an activation/deactivation signal that controls the mechanical components of the speed bump, such as operating the electric motor in the control box 120 of FIG. 16.

Figure 14:
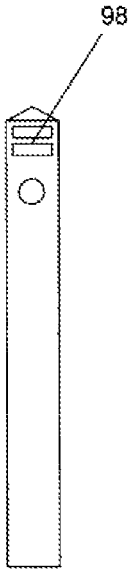
FIG. 14 is a front elevation view of the button for pedestrians.

For the pedestrian crossing, there is a button station 98 placed externally as in FIG. 14. The button station is in communication with the control box. The signals sent by the button station are communicated to the control box to switch the cover between the raised position and the lowered position. A signal corresponding to a pushed button can switch the cover to the raised position for at least 1 to 2 minutes, which is sufficient time for pedestrians to cross the street.

Best Way to Implement the Invention

Regarding the way to implement the invention, the box 10 can be placed underground on a street, where reduction of the speed of vehicles, including trucks, is wanted. The speed bump can be installed in any street or avenue, where traffic is heavy, or on those avenues where speed reduction is required for safety, such as a street with hospitals, clinics or schools.

The speed bump has the restriction of not being capable of being activated/deactivated while a vehicle is driving over the speed bump, to avoid situations or accidents that may put the safety of the passenger or possible pedestrians at risk.

All the information collected can be sent to a computer, which stores information on highway administration, such as statistics on peak hours, advances in road safety education, vehicle pollution in the area, and flow of vehicles. The information can be organized by zone or block or street, etc.

Once the vehicle is a few meters away from the speed bump and based on the information received by the sensors, a signal is sent according to whether said vehicle is running within the allowed speed limit for that street and previous street conditions, so that the signal either keeps the cover in the raised position or lowered position or switches from the position. For example, with a button station and a programmable control card, the signal corresponding to a pushed button can switch the cover to the raised position, which overrides the signal corresponding to a vehicle above an allowed limit and another signal corresponding to another vehicle lower or equal to the allowed limit from the programmable control card. Alternatively, the signal corresponding to a pushed button can switch the cover to the raised position as a default position, until another signal corresponding to another vehicle lower or equal to the allowed limit is communicated to the control box by the programmable control card.

Figure 15:
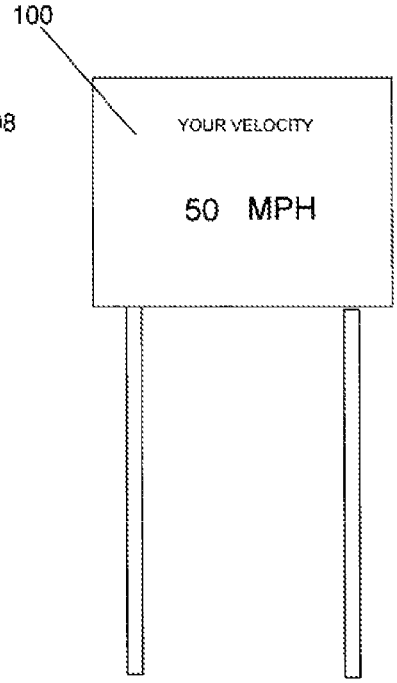
FIG. 15 is a schematic view of the information screen.

Vehicle or truck drivers will initially be able to see LED signs 100 of FIG. 15, which show the speed they are driving at, followed by a traffic light 90 that indicates whether to reduce speed. There can also be signs 92 that indicate the allowed speed limit.

This signs 100 are preferably lit and can include information legends such as "CAUTION ELEVATING PLATFORM AT "X" METERS" or "YOUR AVERAGE SPEED WAS "X" KM/H".

To allow emergency vehicles, such as police cars, ambulances, fire trucks and other to pass, the sign 92, can also have a sound sensor 94, which sends the signal to the control box to switch the cover the raised position or the lowered position.

In case of placing the speed bump on a highway, where the average speed is high, the sign 92, can include a radar 96.

The light dot matrix panel, where the messages and the result of the communication with the radar appear, is formed by a cluster or groups of amber monochromatic light emitting diodes, having a visibility angle of 120 degrees and a vision distance of approximately 500 meters. The panel can have the capacity to show up to 3 lines of text.

I claim:

1. A selectively activated speed bump, comprising:

a cover having a raised position and a lowered position and being comprised of a central part and two lateral parts;

a metallic rectangular box being mounted underneath said cover, having side walls on longitudinal sides of the box and end walls at opposite ends of the box, and being comprised of a metallic frame inside the box so as to reinforce the box, each lateral part resting on said metallic frame, said metallic frame supporting each lateral part;

a plurality of grooves in at least one end wall;

a plurality of security plates, each security plate being placed on a respective end wall of the box and having a displaced position when said cover is in said raised position so as to maintain the box sealed;

a plurality of safety plates, each safety plate being placed on a respective side wall of the box and being comprised of plastic so as to contact and soften impact on the box;

a shaft being comprised of a terminal end' supported at one end wall of the box by a pillow block, a center portion being reinforced with a plurality of bearings unit within the box, and an axle end being projected outside of the box;

a flexible coupling connected to said axle end so as to join to a second shaft;

a control box having a movement mechanism, said second shaft being connected to said control box;

a plurality of eccentric cams, each cam having a larger side and a smaller side and being mounted on said central portion of said shaft, wherein the cams are aligned with respective larger sides engaged to said cover in said raised position of said cover;

a plurality of load supports between said shaft and a bottom of the box, each load support being comprised of a block with a cross-cut and being placed along said length of said central portion of said shaft within the box;

an electric motor being in a rotating connection to said second shaft, said movement mechanism being comprised of said electric motor, wherein said electric motor is rotatably engaged to said shaft so as to rotate the cams, engaging respective larger sides to said cover in said raised position and releasing respective larger sides from said cover in said lowered position;

a mass ultrasonic sensor being in communication with said control box, said mass ultrasonic sensor being comprised of a doppler oscillator, wherein microwaves having a distance range of two miles so as to detect objects bigger that 10 cubic feet and being powered by 12 volts DC, are detected by a receiver of said mass ultrasonic sensor when reflected, and wherein signals sent by said mass ultrasonic sensor according to said microwaves are communicated to said control box so as to switch said cover between said raised position and said lowered position;

a radar being in communication with said control box, wherein signals sent by said radar are communicated to said control box so as to switch said cover between said raised position and said lowered position;

a sound sensor placed at a certain known distance and being in communication with said control box, wherein signals sent by said sound sensor are communicated to said control box so as to switch said cover between said raised position and said lowered position;

a light dot matrix panel being in communication with said control box, wherein signals sent by said mass ultrasonic sensor, radar, and sound sensor are communicated to said control box so as to generate a message corresponding to said signals displayed on the dot matrix panel, the dot matrix panel being comprised of at least one of a group consisting of a cluster of light emitting diodes, and monochromatic amber groups of light emitting diodes having a visibility angle of 120 degrees and a vision distance of approximately 500 meters, said message being comprised of less than three text lines;

a button station being placed externally from the box and being in communication with said control box, wherein signals sent by said button station are communicated to said control box so as to switch said cover between said raised position and said lowered position, wherein a signal corresponding to a pushed button switches said cover to said raised position for at least 1 to 2 minutes; and a programmable control card being in communication with said control box, wherein signals sent by said programmable control card are communicated to said control box so as to switch said cover between said raised position and said lowered position, wherein a signal corresponding to a vehicle above an allowed limit switches said cover to said raised position, and wherein another signal corresponding to another vehicle lower or equal to said allowed limit switches said cover to said lowered position.

2. The speed bump, according to claim 1, wherein said signal corresponding to a vehicle above an allowed limit and said another signal corresponding to another vehicle lower or equal to said allowed limit are determined by detected audible 34.7 GHz microwaves.

3. The speed bump, according to claim 1, wherein said signal corresponding to a pushed button switches said cover to said raised position and being sent by said button station overrides said signal corresponding to a vehicle above an allowed limit and said another signal corresponding to another vehicle lower or equal to said allowed limit.

4. The speed bump, according to claim 1, wherein said signal corresponding to a pushed button switches said cover to said raised position as a default position, until said another signal corresponding to another vehicle lower or equal to said allowed limit is communicated to said control box.

* * * * *